US010743120B2

(12) United States Patent
Bern

(10) Patent No.: US 10,743,120 B2
(45) Date of Patent: Aug. 11, 2020

(54) BONE CONDUCTION HEARING AID WITH AN AIR GAP ADJUSTMENT MECHANISM

(71) Applicant: Oticon Medical A/S, Smørum (DK)

(72) Inventor: Bengt Bern, Askim (SE)

(73) Assignee: Oticon Medical A/S, Smørum (DK)

( * ) Notice: Subject to any disclaimer, the term of this patent is extended or adjusted under 35 U.S.C. 154(b) by 0 days.

(21) Appl. No.: 16/189,282

(22) Filed: Nov. 13, 2018

(65) Prior Publication Data

US 2019/0149930 A1 May 16, 2019

(30) Foreign Application Priority Data

Nov. 14, 2017 (EP) ..... 17201522

(51) Int. Cl.
*H04R 25/00* (2006.01)
*H04R 9/06* (2006.01)
*H04R 11/02* (2006.01)

(52) U.S. Cl.
CPC ..... *H04R 25/606* (2013.01); *H04R 9/06* (2013.01); *H04R 11/02* (2013.01); *H04R 2225/67* (2013.01); *H04R 2460/13* (2013.01)

(58) Field of Classification Search
USPC ..... 381/151, 326, 380
See application file for complete search history.

(56) References Cited

U.S. PATENT DOCUMENTS 2,127,468 A 8/1938 Greibach
2009/0310813 A1 12/2009 Sumitani et al.
2011/0317859 A1 12/2011 Jinton

*Primary Examiner* — Suhan Ni
(74) *Attorney, Agent, or Firm* — Birch, Stewart, Kolasch & Birch, LLP

(57) ABSTRACT

An electromagnetic vibrator for a bone conduction hearing aid is disclosed. The electromagnetic vibrator comprises a magnet arrangement comprising a central portion, a coil wound around the central portion and being configured to generate a dynamic magnetic field and at least one permanent magnet configured to generate a static magnetic field. The electromagnetic vibrator further comprises a vibrator plate arranged in position and in such a manner that a gap, extending across a longitudinal axis of the electromagnetic vibrator is provided between the vibrator plate and at least one of said central portion or at least one permanent magnet. The electromagnetic vibrator further comprises an encasing surrounding at least a portion of the magnet arrangement. The magnet arrangement includes a bobbin assembly and encasing comprise a gap adjustment mechanism that is configured to move the bobbin assembly relative to the encasing for adjusting the gap between the vibrator plate and at least one of said central portion or at least one permanent magnet.

19 Claims, 7 Drawing Sheets

BONE CONDUCTION HEARING AID WITH AN AIR GAP ADJUSTMENT MECHANISM

FIELD

The present disclosure relates to an electromagnetic vibrator for a bone conduction hearing aid, which is configured to create perception of hearing to a user by transmitting sound vibrations through the bones of the user's head. More particularly, the disclosure relates to the electromagnetic vibrator (transducer) comprising a bobbin assembly and an encasing having a gap adjustment mechanism, by which it is possible to adjust an air gap between a vibrator plate and the bobbin assembly.

BACKGROUND

Hearing by bone conduction as a phenomenon, i.e., conduction of sound to the inner ear through the bones of the skull, is known. Electromagnetic transducers combine properties such as small size, wide frequency range, high impedance, and efficient energy transformation; hence, they are widely used in hearing aid applications. Such transducers include a vibrator plate and bobbin assembly and a small air gap therebetween. By superimposing a signal magnetic flux generated by a coil wound around a bobbin (central portion) the force in the air gap, between the vibrator plate and bobbin assembly, is produced.

The size of the air gap is crucial to the energy efficiency of the vibrator and should therefore be kept as small as possible, while at the same time, collapse of the air gap needs to be avoided. For this reason, a very precise adjustment of the air gap is very important.

Therefore, there is a need to provide a solution that makes it possible to provide a very precise and simple adjustment of the air gap.

SUMMARY

According to an aspect, a bone conduction hearing aid comprises the disclosed electromagnetic vibrator. In an embodiment, a percutaneous bone anchored hearing aid includes an implantable titanium percutaneous screw-abutment that is surgically implanted into the skull, and a separate external device adapted to couple with the implanted screw-abutment. The external device includes a sound input component, speech processor, the electromagnetic vibrator and a power unit. The sound input component, such as microphone, is adapted to receive an incoming sound such as from auditory environment or a test signal (sound signal) and to generate a corresponding electrical signal. The electronics module (speech processor) is adapted to process the electrical signal including amplifying the electrical signals and accordingly to drive the vibrator (transducer) that is adapted to convert the electrical signal into a mechanical force for delivery to the recipient's skull. The vibrator is configured to generate vibrations typically substantially along one displacement axis (i.e. longitudinal axis) that is usually substantially perpendicular to skull surface. The power unit provides an electrical supply current and voltage for the electronics module and the vibrator. A conventional vibration unit includes an armature (magnet arrangement+encasing), a yoke (vibrator plate) and an air gap. A spring suspension connects the yoke to the armature, thereby maintaining the essential air gap between them. The magnetic flux is composed of the static flux generated by a permanent magnet and a dynamic flux is generated by the current in coil(s) surrounding a bobbin. Transmission of the alternating current signal of an amplifier of the electronics module to the terminals of the coil causes the armature to vibrate because of the modulated magnetic field. The vibrations produced in response to the total force is then transmitted to the skull via the implanted titanium percutaneous screw-abutment. The received vibrations at the skull is delivered to the cochlea by sending vibrations through the skull. The total force that the vibration unit generates between the yoke and the armature is approximately proportional to the total magnetic flux square, i.e. $F_{tot} \alpha (\Phi_s+\Phi_\sim)^2=\Phi_s^2+2\,\Phi_s\Phi_\sim+\Phi_\sim^2$ where $\Phi_s^2$ represents stating force from the permanent magnet, $2\,\Phi_s\Phi_\sim$ represents the desired signal force and $\Phi_\sim^2$ represents an undesired distortion force. It is evident that the signal force generated thus relates to the dynamic flux and in turn, to the applied alternating current to the coil where the applied current is dependent upon frequency specific signal level of the incoming sound and a desired force based on frequency specific hearing threshold of the user. This is generally also applicable for other vibration unit technologies.

The disclosure is described above in relation to a percutaneous bone anchored hearing aid. However, it is evident that the disclosure is also applicable on other bone conduction hearing aids adapted to produce hearing perception using transmission of vibrations through skull bone to cochlea such as in transcutaneous bone conduction hearing aids, which may be both direct drive i.e. vibrations delivered directly to the skull bone such as bone conduction device having an implanted vibration unit or passive drive i.e. vibrations delivered indirectly such as through skin to the skull bone.

According to an aspect, an electromagnetic vibrator is disclosed. The electromagnetic vibrator includes

- a magnet arrangement comprising a central portion, a coil wound around the central portion and being configured to generate a dynamic magnetic field and at least one permanent magnet configured to generate a static magnetic field;
- a vibrator plate arranged in position and in such a manner that a gap, extending across a longitudinal axis of the electromagnetic vibrator is provided between the vibrator plate and at least one of said central portion or at least one permanent magnet; and
- an encasing surrounding at least a portion of the magnet arrangement, wherein the magnet arrangement comprises a bobbin assembly and encasing comprise a gap adjustment mechanism that is configured to move the bobbin assembly relative to the encasing for adjusting the gap between the vibrator plate and at least one of said central portion or at least one permanent magnet.

Hereby, it is possible to provide a very precise adjustment of the gap. Furthermore, the gap can be increased or decreased the gap in a simple manner. The gap may be referred to as an air gap.

The magnet arrangement comprises a central portion and a coil wound around the central portion. Accordingly, the coil is arranged and configured to generate a dynamic magnetic flux. The magnet arrangement moreover comprises at least one permanent magnet configured to generate a static magnetic field.

The electromagnetic vibrator also comprises a vibrator plate. The vibrator plate is arranged in position and in such a manner that a gap, extending across a longitudinal axis of the electromagnetic vibrator is provided between the vibrator plate and at least one of said central portion or at least one permanent magnet. the central portion. This means that the gap has a lengthwise gap axis extending perpendicular to the longitudinal axis of the electromagnetic vibrator.

The longitudinal axis of the electromagnetic vibrator may be defined as the axis that extends along a distance from one end of the bobbin assembly towards the coupling.

The longitudinal axis of the electromagnetic vibrator may also be defined as the axis along which the counterweight vibrates or moves.

The longitudinal axis of the electromagnetic vibrator may also be defined as the axis extending in parallel with a longitudinal length of the central portion of which the coil is wound around, wherein the longitudinal length of the central portion defines a length which is larger than a transverse length of the central portion.

The longitudinal axis of the electromagnetic vibrator may also be defined as the axis being parallel or substantially parallel to the skin of the user when the electromagnetic vibrator is worn by the user.

The electromagnetic vibrator also comprises an encasing surrounding at least a portion of the magnet arrangement, wherein the magnet arrangement comprises a bobbin assembly being moveably arranged, using the gap adjustment mechanism, relative to the encasing.

The magnet arrangement includes the bobbin assembly comprising the central portion, the coil, and at least one permanent magnet.

In an embodiment where the coil and permanent magnet are attached to the bobbin assembly, it is apparent that when the gap is increased or decreased, the bobbin assembly as well as the coil and permanent magnet are moved.

In one embodiment, the bobbin assembly includes a first adjustment part and the encasing includes a second adjustment part, wherein the first adjustment part and the second adjustment part are configured to co-operate with each other to adjust the gap.

According to another aspect of the disclosure, the encasing is a counterweight assembly, and the adjustment mechanism is configured to move the counterweight assembly and the bobbin assembly relative to one another along the longitudinal axis of the electromagnetic vibrator.

In one embodiment, the adjustment mechanism comprises a first part and a second part, wherein the first part and the second part are engagingly arranged relative to each other, wherein the configuration of the first part and the second part relative to each other determines the size of the gap. Accordingly, by changing the configuration of the first part and the second part relative to each other determines the size of the gap.

In an embodiment according to the disclosure, the first part comprises a first threaded portion and the second part comprises a second corresponding engagingly threaded portion. Hereby, it is possible to provide an accurate adjustment of the gap by rotating the first part relative to the second part. Rotation may be achieved by applying a clockwise or anti-clockwise directed torque.

In an embodiment according to the disclosure, the encasing includes a protruding portion and the bobbin assembly includes a corresponding receiving portion adapted to engagingly receive said protruding portion. The protruding portion may be formed as an elongated body (e.g. a pin) configured to be received by a corresponding (e.g. L-shaped slot) female receptor, wherein the protruding portion and the female receptor together constitute bayonet-type connection.

In one embodiment according to the disclosure, the bobbin assembly and the encasing are moveably attached to each other by means of one or more connections utilizing bayonet principle.

In a further embodiment according to the disclosure, the bobbin assembly includes a protruding portion and the encasing includes a corresponding receiving portion adapted to engagingly receive said protruding portion.

In an even further embodiment according to the disclosure, the encasing and the vibrator plate are directly or indirectly connected using a mechanical spring, thus maintaining the airgap between the magnet arrangement and vibrator plate.

In one embodiment according to the disclosure, the bobbin assembly and the encasing are moveably attached to each other by means of a number of corresponding female members and movably arranged male members provided in the bobbin assembly and the encasing, respectively.

In another embodiment according to the disclosure, the bobbin assembly comprises an annular groove surrounding the central portion, wherein the coil is arranged in the groove.

In a further embodiment according to the disclosure, the at least one permanent magnet is formed as an annular disc arranged in a position, in which the permanent magnet extends along an end portion of the bobbin assembly. Accordingly, it is possible to ease the assembling of the electromagnetic vibrator.

In a preferred embodiment according to the disclosure, the permanent magnet comprises a plurality of separate segments joined together to form an annular ring magnet. Hereby, it is possible to reduce the reluctance of the vibrator by providing a magnet that is thinner than available in the prior art. Prior art permanent for electromagnetic vibrator are difficult to make thin without risking the magnet becoming very fragile. Therefore, having an annular ring magnet comprising a plurality of separate segment joined together allow for making a thinner magnet, thus reducing reluctance in the magnetic circuit without compromising on the strength of the annular ring magnet.

It may be preferred that the plurality of separate segments have equal geometry.

In an embodiment, the permanent magnet comprises at least two segments joined together to form the annular ring magnet.

In the prior art electromagnetic vibrators, the dynamic magnetic field created by the coil passes through the same magnetic circuit as the static field created by the permanent magnet. In order to achieve the highest possible efficiency (the highest force output for a given power input) of the magnetic circuit, the reluctance (magnetic resistance) of the magnetic circuit must be minimised. The reluctance is given by the following equation:

$$R = \frac{L}{\mu_0 \mu_r A} \tag{1}$$

Where L is the length of the circuit, A is the cross-sectional area of the circuit, $\mu_0$ is the permeability of vacuum, $\mu_r$ is the relative magnetic permeability of the material.

In magnetic conductive materials $\mu_r$ is typically in the range of 10000-20000 H/m. In air and in the magnet, $\mu_r$ is 1. The magnet is typically rather thick (about 1 mm) compared to the inner and outer air gap (which is about 60-150 μm).

The total reluctance is given by the sum of the of reluctances of the components constituting the total circuit the magnet is a large contributor to the total reluctance. Therefore, to lower the reluctance of the vibrator it is desirably to make the magnet thin. However, a thin magnet will become fragile and can easily break.

In an embodiment according to the disclosure, the permanent magnet comprises at least three segments. In a preferred embodiment according to the disclosure, the permanent magnet comprises four segments.

In an embodiment according to the disclosure, the bobbin assembly is rotatably attached to the encasing. It may be an advantage that bobbin assembly is rotatably attached to the encasing by means of a coupling mechanism that causes the bobbin assembly to be axially displaced relative to the encasing upon being rotated. Hereby, it is possible to provide a very precise adjustment of the gap in a simple manner.

In one embodiment according to the disclosure, the bobbin assembly comprises a first adjustment part formed as an outer periphery provided with a threaded portion provided at an outer periphery of the bobbin assembly, wherein the bobbin assembly comprises a second adjustment part formed as a corresponding threaded portion provided at the inner side of the encasing engaging with the threaded portion provided at an outer periphery of the bobbin assembly a corresponding threaded portion provided at the inner side of the encasing.

In an embodiment, the gap adjustment mechanism includes a first adjustment part, provided at an outer periphery of the bobbin assembly, the first adjustment part includes one of at least one protruding portion or a plurality of receiving sections. The mechanism further includes a second adjustment part, provided at an inner side of the encasing, the second adjustment part comprising another of a plurality of corresponding receiving sections that is configured to operationally cooperate with the at least one protruding portion of the first adjustment part or at least one corresponding protruding portion that is configured to operationally co-operate with the plurality of receiving sections of the first adjustment part.

Hereby, it is possible to turn the bobbin assembly to increase or decrease the gap between the central portion of the bobbin assembly and the vibrator plate.

In one embodiment according to the disclosure, the number of segments in the plurality of separate segments is inversely related to the height (thickness) of the permanent magnet. This means that a larger number of separate segments are applied when the height of the permanent magnet is large than when the height of the permanent magnet is smaller.

In one embodiment according to the disclosure, the inverse relationship between number of segments in the plurality of separate segments with respect to the height is defined in such a manner that the when the height is reduced by two times the number of segments is increased by four times.

In a preferred embodiment according to the disclosure, the permanent magnet comprises four separate segments joined together to form an annular ring magnet, wherein the height of the segments is 0.2-0.8 mm, preferably 0.4-0.6 mm, such as 0.5 mm.

In another embodiment according to the disclosure, the inverse relationship between number of segments in the plurality of separate segments with respect to the height is defined in such a manner that the when the height is reduced by two times the number of segments is increased by three times.

In a further embodiment according to the disclosure, the inverse relationship between number of segments in the plurality of separate segments with respect to the height is defined in such a manner that the when the height is reduced by two times the number of segments is increased by five times.

In an even further embodiment according to the disclosure, the number of segments in the plurality of separate segments depend upon the mechanical strength of the segments of the plurality of segments. It is preferred that a larger number of segments are applied when the mechanical strength is low, whereas a smaller number of segments are applied when the mechanical strength is higher. The mechanical strength means its ability to withstand an applied load without failure or plastic deformation. In one embodiment according to the disclosure, the mechanical strength is the yield strength of the segments. In another embodiment according to the disclosure, the mechanical strength is the compressive strength of the segments. In a further embodiment according to the disclosure, the mechanical strength is the tensile strength of the segments.

In an even further embodiment according to the disclosure, the gap between the central portion of the magnet arrangement and the vibrator plate is smaller than the gap between the at least one permanent magnet and the vibrator plate. It may be preferred that the gap between the central portion of the magnet arrangement and the vibrator plate is in the range 20-100 μm, such as 40-80 μm preferably approximately 60 μm, wherein the gap between the at least one permanent magnet and the vibrator plate is in the range 100-200 μm, such as 120-180 μm preferably approximately 150 μm.

In one embodiment according to the disclosure, a gap is provided between the at least one permanent magnet and the encasing. Hereby, it is possible to rotate the bobbin assembly relative to the encasing.

In another embodiment according to the disclosure, the electromagnetic vibrator is symmetric with respect to the longitudinal axis of the electromagnetic vibrator.

In a further embodiment according to the disclosure, the gap adjustment mechanism comprises a first adjustment part comprising at least one of:

at least one protruding portion or a plurality of receiving sections, wherein the gap adjustment mechanism comprises a second adjustment part comprising:

the at least one corresponding protruding portion or a plurality of corresponding receiving sections.

The first adjustment part may comprise one or more protruding portions, whereas the second adjustment part comprises a plurality of corresponding receiving sections.

The first adjustment part may comprise a plurality of receiving sections, whereas the second adjustment part comprises one or more corresponding protruding portions.

In an embodiment according to the disclosure, the first adjustment part and/or the second adjustment part forms the adjustment mechanism utilizing bayonet mount principle. This means that the first adjustment part and/or the second adjustment part constitute structures of a bayonet mount. It may be preferred that both the first adjustment part and the second adjustment part constitute structures of a bayonet mount.

In another embodiment according to the disclosure, the first adjustment part and/or the second adjustment forms the adjustment mechanism utilizing the ratchet principle. This means that the first adjustment part and/or the second adjustment part constitute structures of a ratchet mount (a mechanical device that allows continuous linear or rotary motion in only one direction while preventing motion in the opposite direction). It may be preferred that both the first adjustment part and the second adjustment part constitute structures of a ratchet.

In a further embodiment according to the disclosure, the pitch of the threads of the at least one threaded portion:

a) provided at an outer periphery of the bobbin assembly and the threaded portion provided at the inner side of the encasing;

b) provided at the receiving section of bayonet mount or c) provided at the receiving section of a ratchet mount, is selected to achieve a predefined revolution specific change of the gap between the vibrator plate and the central portion.

The pitch of a thread is the distance, measured parallel to its axis, between corresponding points on adjacent surfaces, in the same axial plane.

In one embodiment according to the disclosure, the threads are shaped in such a manner that the gap between the vibrator plate and the central portion is changed approximately 50 μm per revolution.

In another embodiment according to the disclosure, the threads are shaped in such a manner that the gap between the vibrator plate and the central portion is changed a predefined distance expressed in μm per revolution.

In one aspect of the disclosure, a bone conduction hearing aid comprises an electromagnetic vibrator according to the disclosure.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
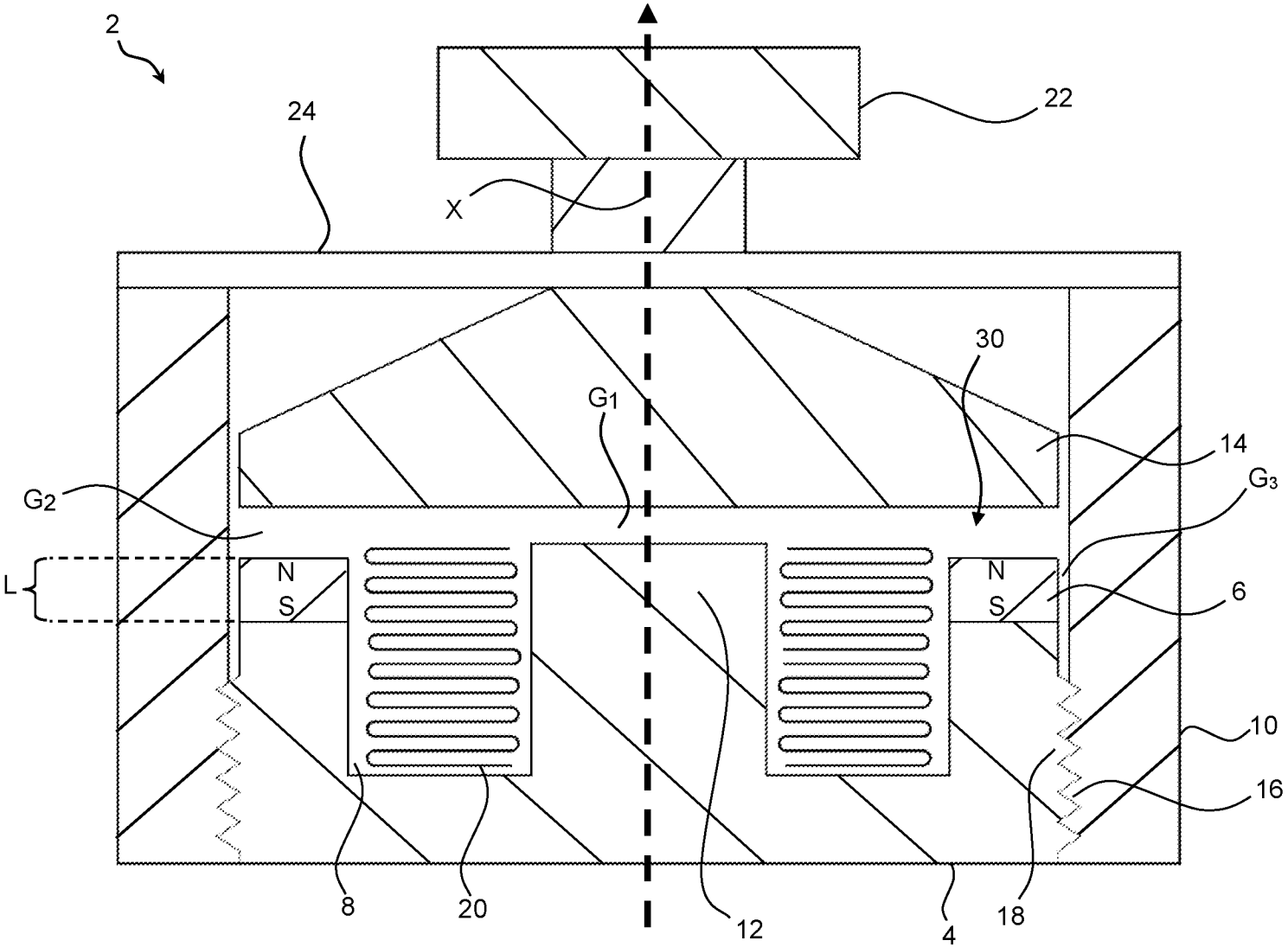
FIG. 1 shows a cross-sectional view of an electromagnetic vibrator according to an embodiment.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, etc. (collectively referred to as "elements"). Depending upon particular application, design constraints or other reasons, these elements may be implemented using other equivalent elements.

The hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal transferred as mechanical vibrations to the user's inner ears through bone structure of the user's head.

The hearing aid is adapted to be worn in any known way. This may include arranging a unit of the hearing aid attached to a fixture implanted into the skull bone such as in a Bone Anchored Hearing Aid or at least a part of the hearing aid may be an implanted part.

A "hearing system" refers to a system comprising one or two hearing aids, and a "binaural hearing system" refers to a system comprising two hearing aids where the devices are adapted to cooperatively provide audible signals to both of the user's ears or the hearing aid of bone conduction type may be part of a bimodal system comprising a cochlear implant and a bone conduction hearing aid. The system may further include auxiliary device(s) that communicates with at least one hearing aid, the auxiliary device affecting the operation of the hearing aids and/or benefiting from the functioning of the hearing aids. A wired or wireless communication link between the at least one hearing aid and the auxiliary device is established that allows for exchanging information (e.g. control and status signals, possibly audio signals) between the at least one hearing aid and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing aid. The remote control is adapted to control functionality and operation of the at least one hearing aids. The function of the remote control may be implemented in a SmartPhone or other electronic device, the SmartPhone/electronic device possibly running an application that controls functionality of the at least one hearing aid.

In general, a hearing aid includes i) an input unit such as a microphone for receiving an acoustic signal from a user's surroundings and providing a corresponding input audio signal, and/or ii) a receiving unit for electronically receiving an input audio signal. The hearing aid further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer for providing mechanical vibrations either transcutaneously or percutaneously to the skull bone.

Figure 3:
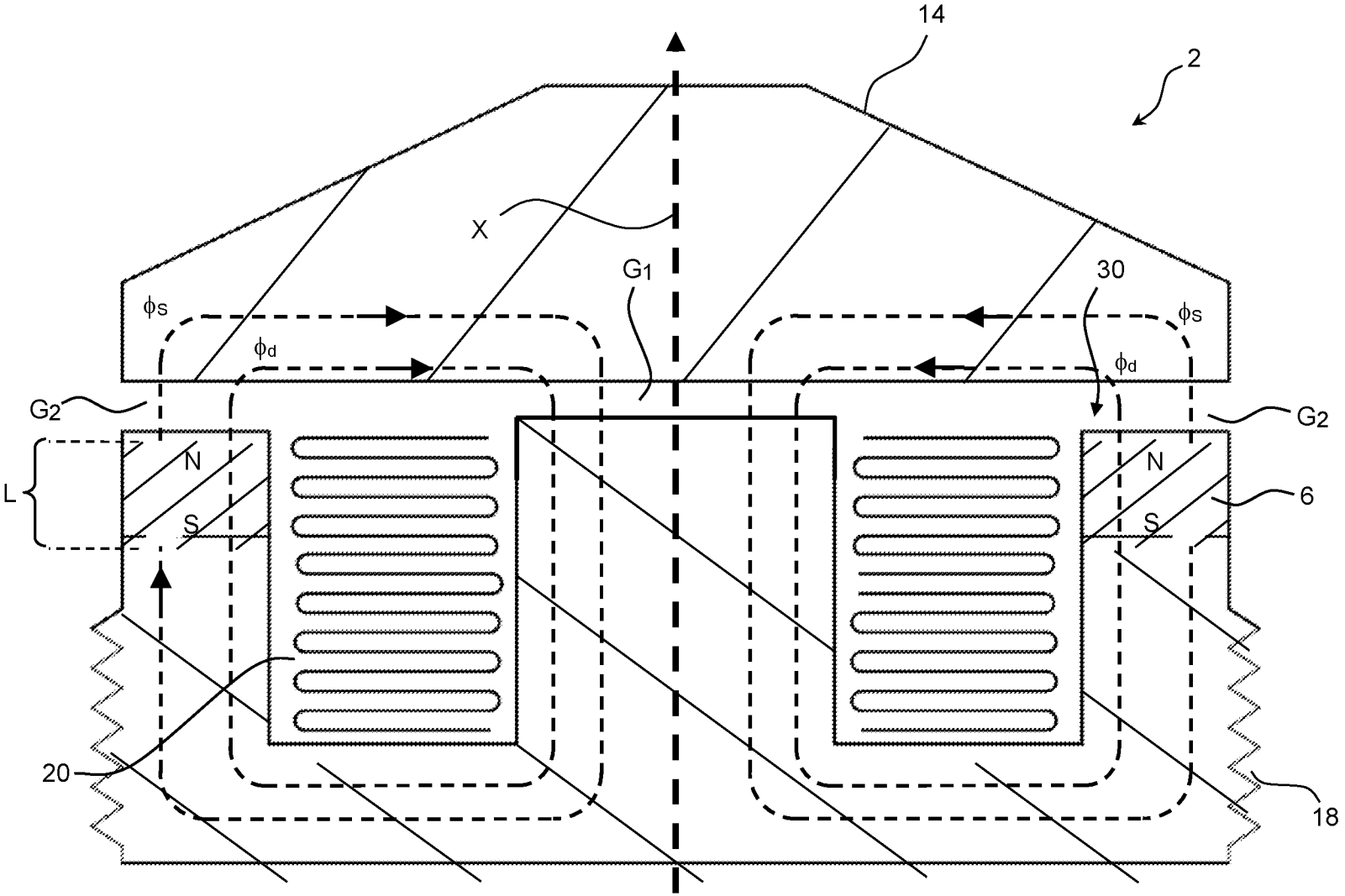
FIG. 3 shows a schematic view of the dynamic magnetic field and the static field of the magnetic circuit in an electromagnetic vibrator according to an embodiment.

Now referring to FIG. 1, which illustrates a cross-sectional view of an electromagnetic vibrator 2 according to one embodiment of the disclosure. The electromagnetic vibrator 2 is configured to be used in a bone conduction hearing aid. The electromagnetic vibrator 2 comprising a magnet arrangement 30 comprising a central portion 12. A coil 20 is wound around the central portion 12 and is being configured to generate a dynamic magnetic field. The coil 20 may be arranged in an annular groove 8. The magnet arrangement 30 comprises a permanent magnet 6 having a north pole N and a south pole S. The permanent magnet 6 is configured to generate a static magnetic field (as shown in FIG. 3).

The electromagnetic vibrator 2 comprises a vibrator plate 14. The vibrator plate 14 is arranged in position in which a gap comprising a first gap (gap portion) $G_1$ and a second gap (gap portion) $G_2$ may be provided between the magnet arrangement 30 and the vibrator plate 14. The gap extends across the longitudinal axis X of the electromagnetic vibrator 2. The first gap (gap portion) $G_1$ that is between the central portion 12 and the vibrator plate 14, may be smaller than the second gap (gap portion) $G_2$ that is between the permanent magnet 6 and the vibrator plate 14. In one embodiment according to the disclosure, the gap (gap portion) $G_1$, between the central portion 12 and the vibrator plate 14 may be approximately 60 μm, whereas the second gap (gap portion) $G_2$, between the permanent magnet 6 and the vibrator plate 14, may be approximately 150 μm.

The electromagnetic vibrator 2 comprises an encasing 10 surrounding the magnet arrangement 30. The magnet arrangement 30 comprises a bobbin assembly 4 that is moveably arranged relative to the encasing 10. The bobbin assembly 4 may be rotatably arranged relative to the encasing 10. Accordingly, the bobbin assembly 4 comprising a gap adjustment mechanism for adjusting the gap $G_1$ between the vibrator plate 14 and the central portion 12 and the gap $G_2$ between the vibrator plate 14 and the permanent magnet 6.

Rotation of the bobbin assembly 4 and the encasing 10 may be carried out because the outside portion (periphery) of the bobbin assembly 4 is provided with a first adjustment part of the adjustment means such as a threaded portion 18 that engages with a corresponding second adjustment part of the adjustment means such as a corresponding threaded portion 16 provided at the inside of the encasing 10. The treads of the threaded portion 16 provided at the inside of the encasing 10 and the threads of the threaded portion 18 of the bobbin assembly 4 are preferably constructed in such a manner that rotation of the bobbin assembly 4 relative to the encasing 10 causes a predefined and desired axial displacement along the longitudinal axis X of the bobbin assembly 4 relative to the encasing 10 and thus the vibrator plate 14. Accordingly, it is possible to adjust the magnitude of the gaps $G_1$, $G_2$ in an easy and accurate manner.

In one embodiment according to the disclosure, the threads of the threaded portion 16 provided at the inside of the encasing 10 and the threads of the threaded portion 18 of the bobbin assembly 4 are constructed through thread pitch value in such a manner that rotation of the bobbin assembly 4 relative to the encasing 10 causes an axial displacement of the bobbin assembly 4 relative to the encasing 10 and thus the vibrator plate 14 of a predetermined distance in μm per revolution is achieved.

The height L of the permanent magnet 6 is indicated. In the illustration, the gap $G_1$, $G_2$ is shown to be smaller than the height L of the permanent magnet 6.

The vibrator plate 14 is generally provided with a plane surface facing the magnet arrangement 30. This is an advantage if the bobbin assembly 4 is rotated relative to the vibrator plate 14.

A gap $G_3$ may be provided between side portions of the vibrator plate 14 and the encasing 10. Accordingly, it is possible to rotate the bobbin assembly 4 relative to the encasing. Hereby, it is possible to rotate the permanent magnet 6 and thus the bobbin assembly 4 to which the permanent magnet 6 is attached, relative to the encasing 10.

The encasing 10 and the vibrator plate 14 are directly or indirectly connected using a mechanical spring 24, thus maintaining the airgap between the magnet arrangement and vibrator plate. The mechanical spring 24 may generally be provided at an end portion of the encasing 10. The end portion may lie proximal to a coupling 22, which is configured to detachably attach to an abutment (not shown).

The longitudinal axis X of the electromagnetic vibrator 2 may extend along a distance from one end of the bobbin assembly 4 towards the coupling 22. The longitudinal axis X of the electromagnetic vibrator 2 may also be defined as the axis along which the counterweight vibrates or moves.

Figure 2:
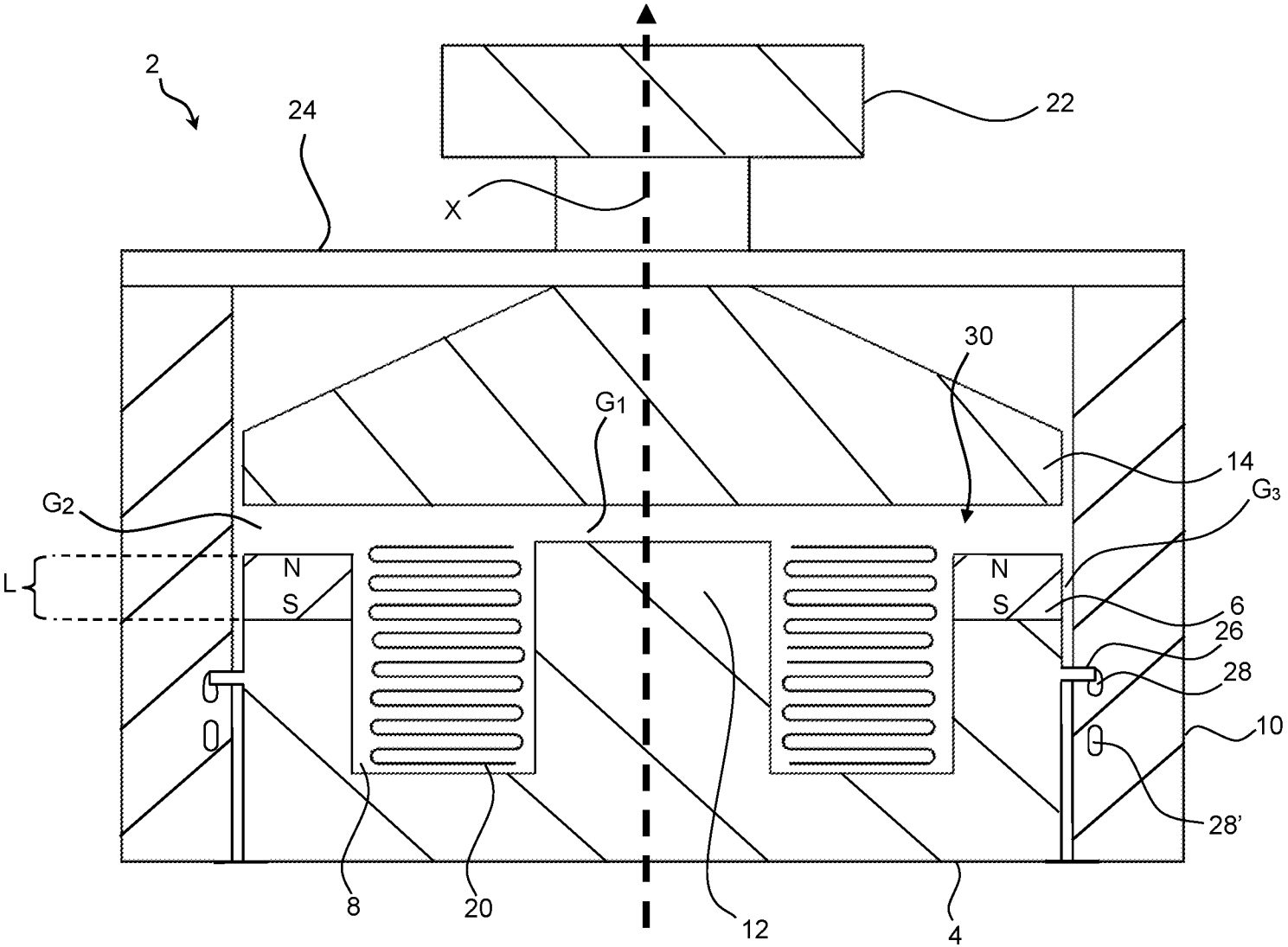
FIG. 2 shows a cross-sectional view of an electromagnetic vibrator according to an embodiment.

FIG. 2 illustrates a cross-sectional view of an electromagnetic vibrator 2 according to another embodiment of the disclosure. The electromagnetic vibrator 2 basically corresponds to the one shown in FIG. 1, however, the bobbin assembly 4 is rotatably arranged relative to the encasing 10 by means of protruding portions 26 protruding radially outwardly from the inside surface of the bobbin assembly 4 and receiving portions 28, 28' at the inside portion of the encasing 10. The protruding portions 26 and the receiving portions 28, 28' may constitute a bayonet connection by which the bobbin assembly 4 is rotatably arranged relative to the encasing 10.

FIG. 3 illustrates a schematic view of the dynamic magnetic field $\phi_D$ and the static field $\phi_S$ of a magnetic circuit in an electromagnetic vibrator 2 according to one embodiment of the disclosure. The electromagnetic vibrator 2 comprises a vibrator plate 14 and a magnet arrangement 30 corresponding to the one shown in FIG. 1 and FIG. 2. It can be seen that the dynamic magnetic field $\phi_D$ created by the coil 20 and the static field $\phi_S$ created by the permanent magnet 6 follow a magnetic circuit, which includes the airgaps G1 and G2. In order to achieve the highest possible force output for a given power input of the magnetic circuit, the reluctance of the magnetic circuit should be as low as possible.

By reducing the height L of the permanent magnet 6, it is possible to reduce the reluctance. Accordingly, in order to lower the reluctance, it is desirable to make the magnet as thin as possible. However, a thin magnet will become fragile and can easily break. By providing a segmented permanent magnet (see FIG. 5A and FIG. 5B) it is possible to reduce the thickness (height) of the magnet without making the permanent magnet unacceptably fragile, i.e. the magnet breaks during manufacturing or use.

Figure 4:
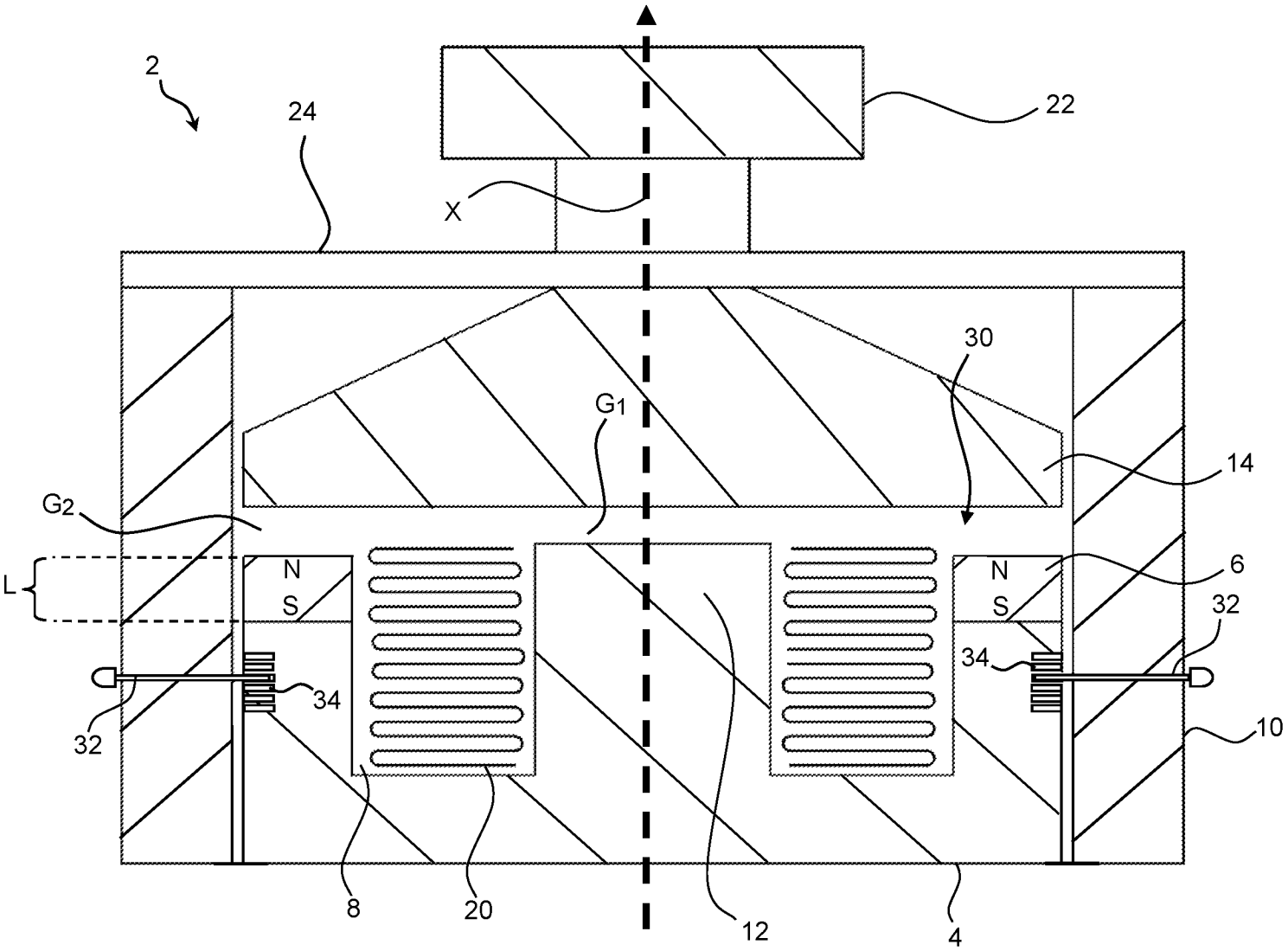
FIG. 4 shows a cross-sectional view of an electromagnetic vibrator according to an embodiment.

FIG. 4 illustrates a cross-sectional view of an electromagnetic vibrator 2 according to another embodiment of the disclosure. The electromagnetic vibrator 2 basically corresponds to the one shown in FIG. 1, however, the bobbin assembly 4 is slidably arranged relative to the encasing 10 by means of male members 32 each being slidably arranged in a radial bore extending through the enclosure 10 and corresponding female members 34 provided in the bobbin assembly 4. The slidable mechanism may incorporate a ratchet principle.

In FIG. 4 more than one such as six female members 34 are provided next to each other to form a receiving portion in the bobbin assembly 4. The male members 32 are configured to be inserted into each of the female members 34. Accordingly, by selecting an appropriate female member 34 and inserting the male member 32 into the selected female member 34, it is possible to change the size of the gap $G_2$ between the permanent magnet 6 and the distal surface of the vibrator plate 14. The male members 32 are provided with a knob arranged in the end. The knob can be used as a handle to grip the male member 32. The knob may also contain a locking arrangement (not shown) configured to lock and unlock the male member 32 relative to the encasing 10.

Figure 5B:
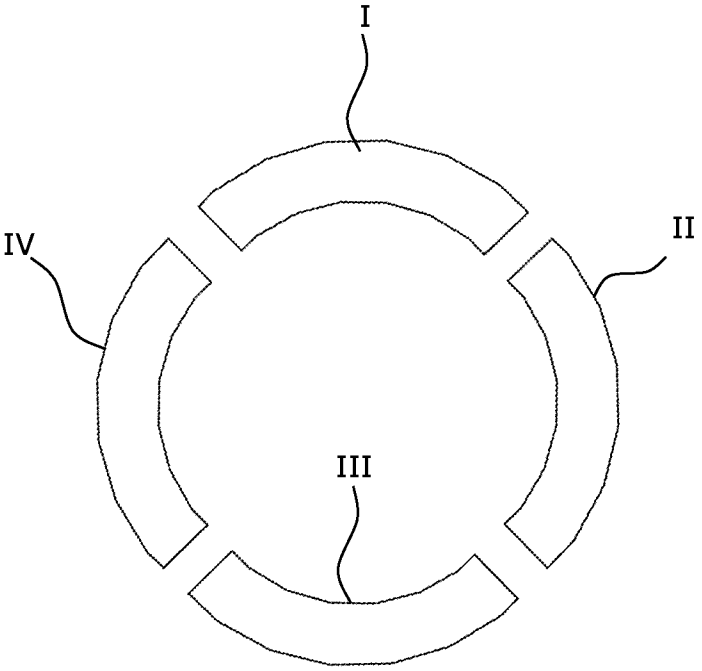
FIG. 5B shows a top view of the permanent magnet shown in FIG. 5A in a disassembled state.
Figure 5A:
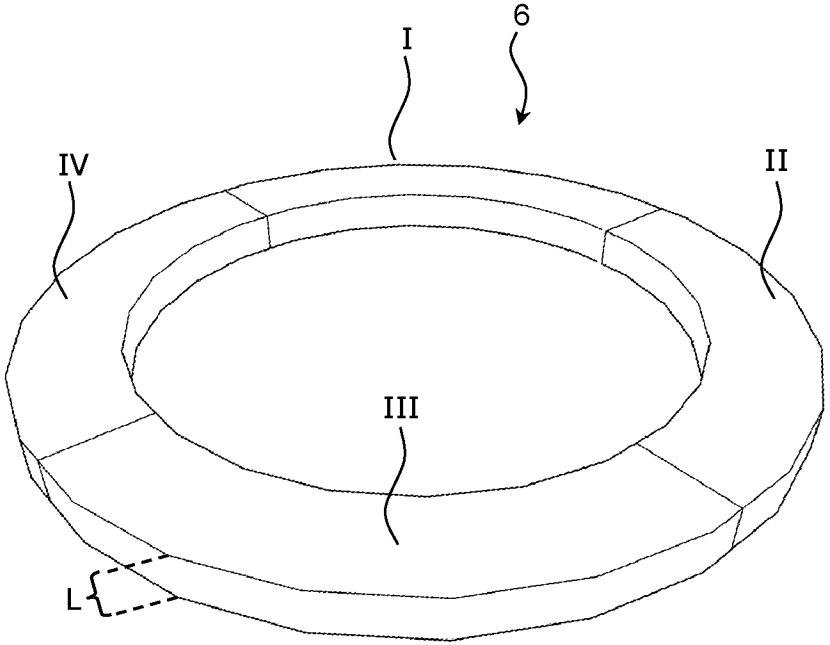
FIG. 5A shows a perspective side view of a permanent magnet of an electromagnetic vibrator according to an embodiment.

FIG. 5A illustrates a perspective side view of a permanent magnet 6 of an electromagnetic vibrator according to another embodiment of the disclosure. The permanent magnet 6 comprises of a plurality of segments I, II, III, IV joined together to form an annular ring magnet. As an example, the permanent magnet 6 comprises four equal sized segments I, II, III, IV each constituting a quarter of an annular ring having a cylindrical geometry. The segments I, II, III, IV have the same height L.

FIG. 5B illustrates a top view of the permanent magnet 6 shown in FIG. 5A in a configuration, in which the segments I, II, III, IV are disjoint before these segments are joined together with one another to form the annular ring magnet.

Figure 6:
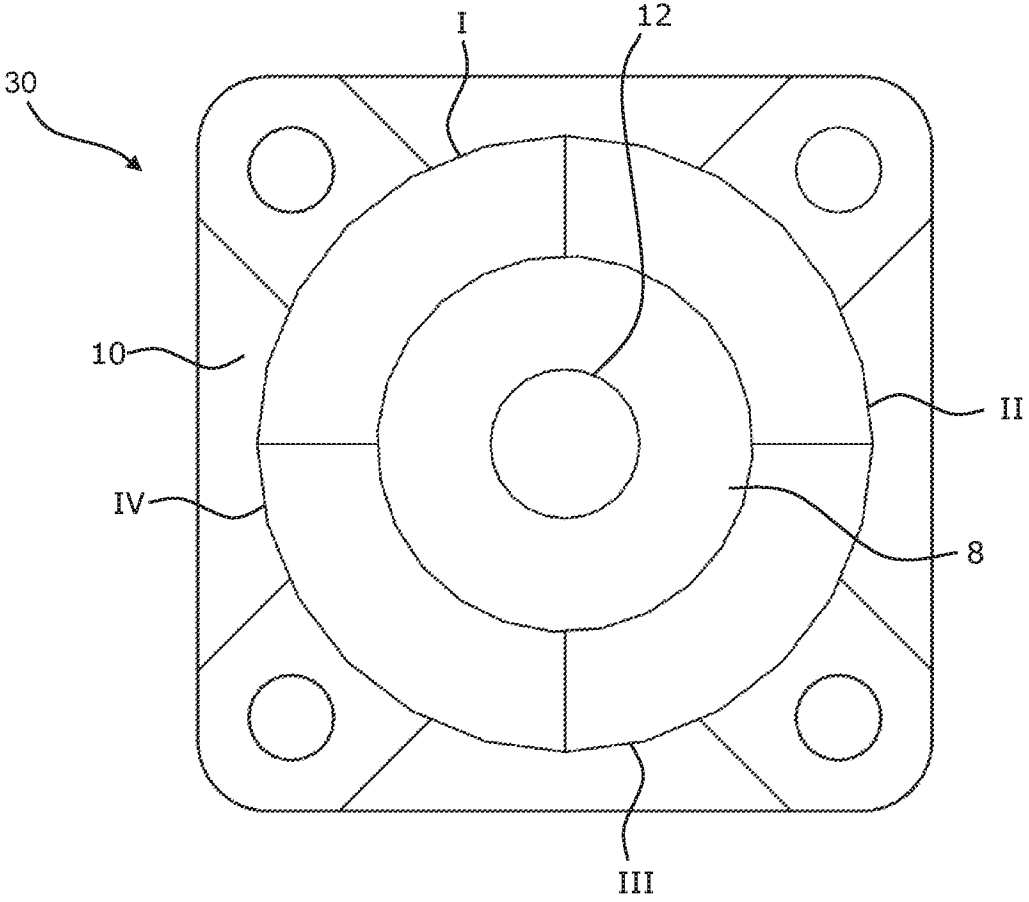
FIG. 6 shows a top view of a magnet arrangement arranged inside an enclosure of an electromagnetic vibrator according to an embodiment.

FIG. 6 illustrates a top view of a magnet arrangement 30 arranged inside an enclosure 10 of an electro-magnetic vibrator according to an embodiment of the disclosure. The magnet arrangement 30 comprises a cylindrical central portion 12 surrounded by an annular groove 8 configured to receive a coil (not shown). The magnet arrangement 30 further comprises a four-segment permanent magnet comprising a first segment I, a second segment II, a third segment III and a fourth segment IV each constituting a quarter of an annular ring. An encasing 10 surrounds the magnet arrangement 30.

Figures 7A, 7B:
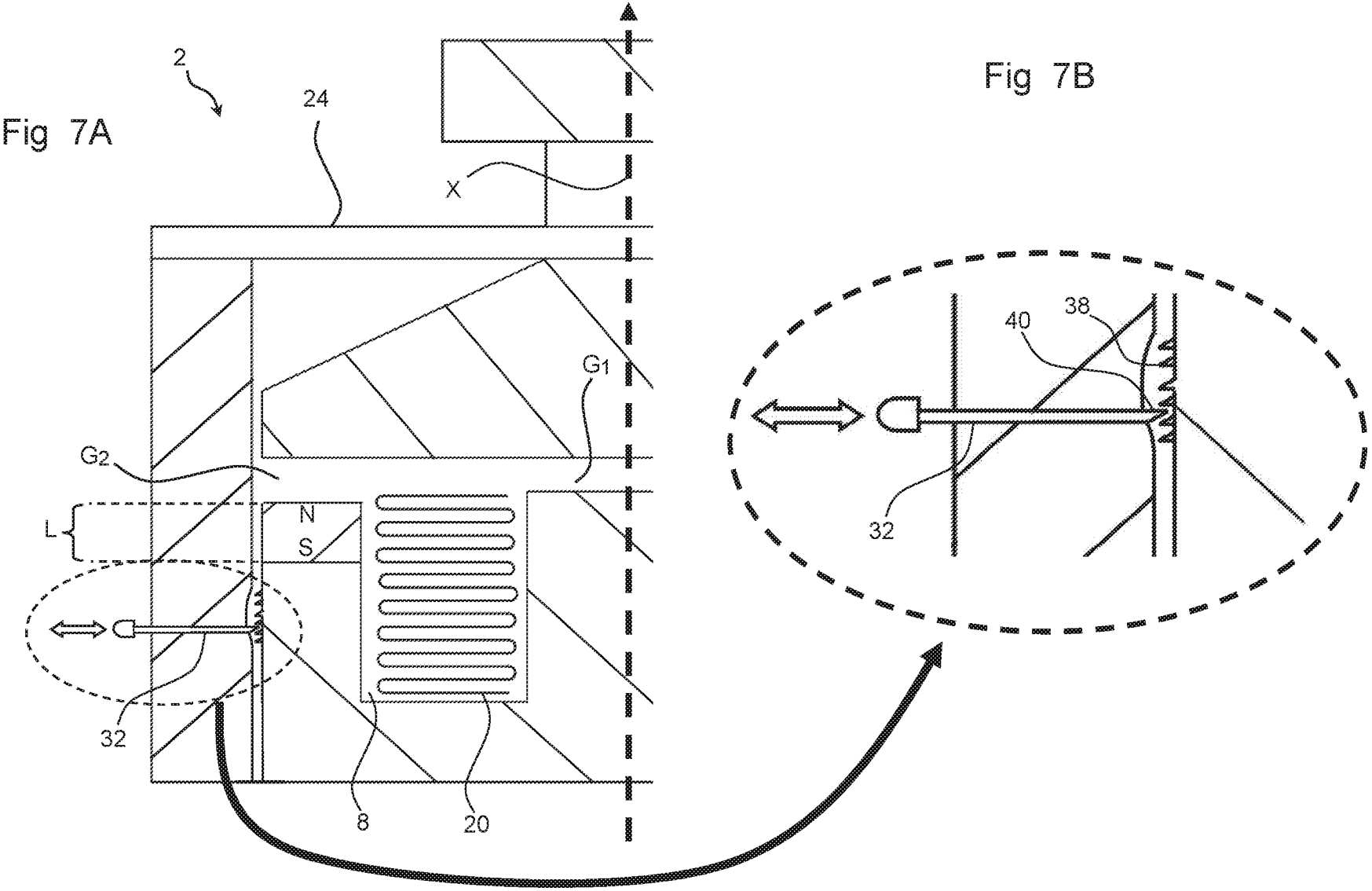
FIG. 7A shows a cross-sectional view of a portion of an electromagnetic vibrator according to an embodiment.
FIG. 7B shows a close-up view of a gap adjustment mechanism of the electromagnetic vibrator shown in FIG. 7A.

FIG. 7A illustrates a cross-sectional view of a portion of an electromagnetic vibrator 2 according to an embodiment of the disclosure. The electromagnetic vibrator 2 basically corresponds to the one shown in FIG. 2, however, the bobbin assembly 4 is slideably arranged relative to the encasing 10 by means of a gap adjustment mechanism comprising a male member 32 having a pointed distal portion 38 configured to be received by receiving structures of a corresponding serrated portion 38 arranged at the outer radial surface of the bobbin assembly 4. The male member 32 is shaped as a pin moveably arranged in a through-bore extending radially in the enclosure 10.

FIG. 7B illustrates a close-up view of the gap adjustment mechanism of the electromagnetic vibrator 2 shown in FIG. 7A. It can be seen that the gap adjustment mechanism comprises a pointed, elongated male member 32 that can be brought into engagement with the serrations of the serrated portion 38. The male member 32 may preferably comprise a locking arrangement configured to keep the male member 32 in engagement with a serration of the serrated portion 38 and to unlock the male member 32 from the locked position.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, elements, components, and/or steps but do not preclude the presence or addition of one or more other features, elements, components, and/or steps thereof. It will also be understood that when an element is referred to as being "connected" or "coupled" to another element, it can be directly connected or coupled to the other element but an intervening elements may also be present, unless expressly stated otherwise. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The scope should be judged in terms of the claims that follow.

The invention claimed is:

1. An electromagnetic vibrator for a bone conduction hearing aid, said electromagnetic vibrator comprising:

a magnet arrangement comprising a central portion, a coil wound around the central portion and being configured to generate a dynamic magnetic field in response to an electric current and at least one permanent magnet configured to generate a static magnetic field;

a vibrator plate arranged in a position with respect to said central portion such that a gap, extending across a longitudinal axis of the electromagnetic vibrator is formed between the vibrator plate and at least one of said central portion or at least one permanent magnet; and an encasing surrounding at least a portion of the magnet arrangement, wherein the magnet arrangement comprises a bobbin assembly and encasing comprise a gap adjustment mechanism that is configured to move the bobbin assembly relative to the encasing for adjusting the gap between the vibrator plate and at least one of said central portion or at least one permanent magnet, and wherein the bobbin assembly is rotatably attached to the encasing.

2. The electromagnetic vibrator according to claim 1, wherein the encasing is a counterweight assembly, and the adjustment mechanism is configured to move the counterweight assembly and the bobbin assembly relative to one another along the longitudinal axis of electromagnetic vibrator.

3. The electromagnetic vibrator according to claim 1, wherein the permanent magnet comprises a plurality of separate segments joined together to form an annular ring magnet.

4. The electromagnetic vibrator according to claim 1, wherein the permanent magnet comprises at least two segments.

5. The electromagnetic vibrator according to claim 3, wherein a number of segments in the plurality of separate segments is inversely related to height of the permanent magnet.

6. The electromagnetic vibrator according to claim 5, wherein the inverse relationship between number of segments in the plurality of separate segments with respect to the height is defined such that the when the height is reduced by 2 times the number of segments is increased by 4 times.

7. The electromagnetic vibrator according to claim 3, wherein the number of segments in the plurality of separate segments is in dependent upon mechanical strength of the segments of the plurality of segments.

8. An electromagnetic vibrator according to claim 1, wherein the gap between the central portion of the magnet arrangement and the vibrator plate is smaller than the gap between the at least one permanent magnet and the vibrator plate.

9. The electromagnetic vibrator according to claim 1, wherein the gap adjustment mechanism comprises a first adjustment part formed as a threaded portion provided at an outer periphery of the bobbin assembly; and a second adjustment part formed as a corresponding threaded portion, configured to operationally co-operate with the threaded portion, provided at an inner side of the encasing.

10. The electromagnetic vibrator according to claim 1, wherein the gap adjustment mechanism comprises a first adjustment part, provided at an outer periphery of the bobbin assembly, the first adjustment part comprising one of at least one protruding portion or a plurality of receiving sections; and a second adjustment part, provided at an inner side of the encasing, the second adjustment part comprising another of:

a plurality of corresponding receiving sections that is configured to operationally cooperate with the at least one protruding portion of the first adjustment part or at least one corresponding protruding portion that is configured to operationally co-operate with the plurality of receiving sections of the first adjustment part.

11. The electromagnetic vibrator according to claim 1, wherein the gap adjustment mechanism comprises a first adjustment part provided at an outer periphery of the bobbin assembly and a second adjustment part provided at an inner side of the encasing, the first adjustment part and the second adjustment part form an adjustment mechanism utilizing a bayonet mount principle.

12. The electromagnetic vibrator according to claim 1, wherein a change in gap between the vibrator plate and central portion is a function of a pitch of the threaded portions, and/or a distance between the plurality of receiving sections.

13. A bone conduction hearing aid comprising the electromagnetic vibrator of claim 1.

14. The electromagnetic vibrator according to claim 2, wherein the permanent magnet comprises a plurality of separate segments joined together to form an annular ring magnet.

15. The electromagnetic vibrator according to claim 2, wherein the permanent magnet comprises at least two segments.

16. The electromagnetic vibrator according to claim 3, wherein the permanent magnet comprises at least two segments.

17. The electromagnetic vibrator according to claim 2, wherein the number of segments in the plurality of separate segments is inversely related to height of the permanent magnet.

18. The electromagnetic vibrator according to claim 3, wherein the number of segments in the plurality of separate segments is inversely related to height of the permanent magnet.

19. An electromagnetic vibrator for a bone conduction hearing aid, said electromagnetic vibrator comprising:

a magnet arrangement comprising a central portion, a coil wound around the central portion and being configured to generate a dynamic magnetic field in response to an electric current and at least one permanent magnet configured to generate a static magnetic field:

a vibrator plate arranged in a position with respect to said central portion such that a gap, extending across a longitudinal axis of the electromagnetic vibrator is formed between the vibrator plate and at least one of said central portion or at least one permanent magnet; and an encasing surrounding at least a portion of the magnet arrangement, wherein the magnet arrangement comprises a bobbin assembly and encasing comprise a gap adjustment mechanism that is configured to move the bobbin assembly relative to the encasing for adjusting the gap between the vibrator plate and at least one of said central portion or at least one permanent magnet, wherein the gap adjustment mechanism comprises a first adjustment part provided at an outer periphery of the bobbin assembly and a second adjustment provided at an inner side of the encasing, the first adjustment part and the second adjustment part forms an adjustment mechanism utilizing a ratchet principle.

* * * * *